US007816976B2

(12) United States Patent
Ogiwara et al.

(10) Patent No.: US 7,816,976 B2
(45) Date of Patent: Oct. 19, 2010

(54) POWER SUPPLY CIRCUIT USING INSULATED-GATE FIELD-EFFECT TRANSISTORS

(75) Inventors: Ryu Ogiwara, Kanagawa-ken (JP); Daisaburo Takashima, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 51 days.

(21) Appl. No.: 12/250,999

(22) Filed: Oct. 14, 2008

(65) Prior Publication Data

US 2009/0108919 A1 Apr. 30, 2009

(30) Foreign Application Priority Data

Oct. 15, 2007 (JP) ..... 2007-268226

(51) Int. Cl.
*G05F 1/10* (2006.01)

(52) U.S. Cl. ..... 327/539; 327/536

(58) Field of Classification Search ..... 327/536, 327/539

See application file for complete search history.

(56) References Cited

U.S. PATENT DOCUMENTS 5,852,376 A * 12/1998 Kraus ..... 327/143
5,880,622 A * 3/1999 Evertt et al. ..... 327/535
5,986,959 A * 11/1999 Itou ..... 365/226
6,519,191 B1 * 2/2003 Morishita ..... 365/189.09
6,535,435 B2 * 3/2003 Tanaka et al. ..... 365/189.09
7,038,954 B2 * 5/2006 Jung ..... 365/189.07
2004/0004513 A1 * 1/2004 Rhee et al. ..... 327/540
2005/0088245 A1 4/2005 Isobe
2005/0135174 A1 * 6/2005 Lee et al. ..... 365/226
2005/0179485 A1 8/2005 Iwase
2005/0264347 A1 12/2005 Gyohten et al.
2007/0024351 A1 * 2/2007 Kang ..... 327/541
2007/0146061 A1 * 6/2007 Iriarte ..... 327/543
2008/0129271 A1 * 6/2008 Fifield ..... 323/313
2009/0096510 A1 * 4/2009 Ogiwara et al. ..... 327/539
2009/0167663 A1 * 7/2009 Ker et al. ..... 345/92

* cited by examiner

*Primary Examiner*—Lincoln Donovan
*Assistant Examiner*—Thomas J Hiltunen
(74) *Attorney, Agent, or Firm*—Oblon, Spivak, McClelland, Maier & Neustadt, L.L.P.

(57) ABSTRACT

A power supply circuit is disclosed. The power supply circuit is provided with a reference voltage generation circuit to receive a voltage from a higher voltage supply so as to generate a reference voltage. The reference voltage from the reference voltage generation circuit is outputted to a power supply voltage generation circuit. The power supply voltage generation circuit boosts the reference voltage to generate a boosted power supply voltage. The boosted power supply voltage is inputted to a bandgap reference circuit. The bandgap reference circuit generates a reference voltage by using the boosted power supply voltage.

13 Claims, 12 Drawing Sheets

POWER SUPPLY CIRCUIT USING INSULATED-GATE FIELD-EFFECT TRANSISTORS

CROSS REFERENCE TO RELATED APPLICATION

This application is based upon and claims the benefit of priority from the prior Japanese Patent Application No. 2007-268226, filed on Oct. 15, 2007, the entire contents of which are incorporated herein by reference.

FIELD OF THE INVENTION

The present invention relates to a power supply circuit employing insulated-gate field-effect transistors to be used for an integrated circuit such as a semiconductor memory device or an SoC (System on Chip).

DESCRIPTION OF THE BACKGROUND

With the development in miniaturization and high-integration of semiconductor elements, strong requirement arises for reduction in voltage of a power source which is used for an integrated circuit such as a semiconductor memory device or an SoC. Accordingly, various reference voltage generating circuits have been developed which operate at a low power supply voltage and which generate a voltage serving as a reference voltage for use of an interior of an integrated circuit.

Japanese Patent Application Publication (Kokai) No. 11-45125 discloses a bandgap reference circuit serving as a reference voltage generating circuit. The bandgap reference circuit includes a bandgap reference section and a comparator. The bandgap reference section can operate at a power supply voltage being as low as about one Volt. However, the comparator does not operate at a power supply voltage of 1.5 Volt or less, for example.

Consequently, the bandgap reference circuit as a whole does not operate at a low power supply voltage of 1.5 Volt or less, for example. When the threshold voltage of a transistor constituting the comparator is lowered to operate the comparator at a low voltage, leak current is increased, which increases power consumption.

SUMMARY OF THE PRESENT INVENTION

An aspect of the invention provides a power supply circuit which includes a reference voltage generation circuit, a power supply voltage generation circuit to receive a reference voltage from the reference voltage generation circuit, the power supply voltage generation circuit boosting the reference voltage to generate a boosted power supply voltage, and a bandgap reference circuit to receive the boosted power supply voltage so as to generate a reference voltage by using the boosted power supply voltage, wherein the reference voltage generation circuit is provided with first and second P-channel transistors, first to fourth N-channel transistors, and first to third resistors, the first P-channel transistor has a source connected to a first higher voltage supply, the second P-channel transistor has a source connected to the first higher voltage supply, a gate of the second P-channel transistor is connected to a drain of the second P-channel transistor and a gate of the first P-channel transistor, a drain of the first N-channel transistor is connected to a drain of the first P-channel transistor, a gate of the first N-channel transistor is connected to the drain of the first N-channel transistor, a gate of the second N-channel transistor is connected to the gate of the first N-channel transistor, a drain of the second N-channel transistor is connected to the drain of the second P-channel transistor, one end of the first resistor is connected to a source of the first N-channel transistor, the first resistor has the other end connected to a lower voltage supply, a drain of the third N-channel transistor is connected to a source of the first N-channel transistor, a gate of the third N-channel transistor is connected to a drain of the third N-channel transistor, the third N-channel transistor has a source to connect to the lower voltage supply, a threshold voltage of the third N-channel transistor is lower than each of the threshold voltages of the first and second N-channel transistors, one end of the second resistor is connected to a source of the second N-channel transistor, the second resistor has the other end to connect to the lower voltage supply, one end of the third resistor is connected to the source of the second N-channel transistor, a drain of the fourth N-channel transistor is connected to the other end of the third resistor, a gate of the fourth N-channel transistor is connected to the drain of the fourth N-channel transistor, the fourth N-channel transistor has a source connected to the lower voltage supply, and a threshold voltage of the fourth N-channel transistor is lower than each of the threshold voltages of the first and second N-channel transistors.

Another aspect of the invention provides a power supply circuit which includes a reference voltage generation circuit to receive a voltage from a higher voltage supply so as to generate a reference voltage, a power supply voltage generation circuit to receive the reference voltage from the reference voltage generation circuit, the power supply voltage generation circuit boosting the reference voltage to generate a boosted power supply voltage, and a bandgap reference circuit to receive the boosted power supply voltage so as to generate a reference voltage by using the boosted power supply voltage.

DETAILED DESCRIPTION OF THE PRESENT INVENTION

Embodiments of the present invention will be described below with reference to the accompanying drawings.

Figure 1:
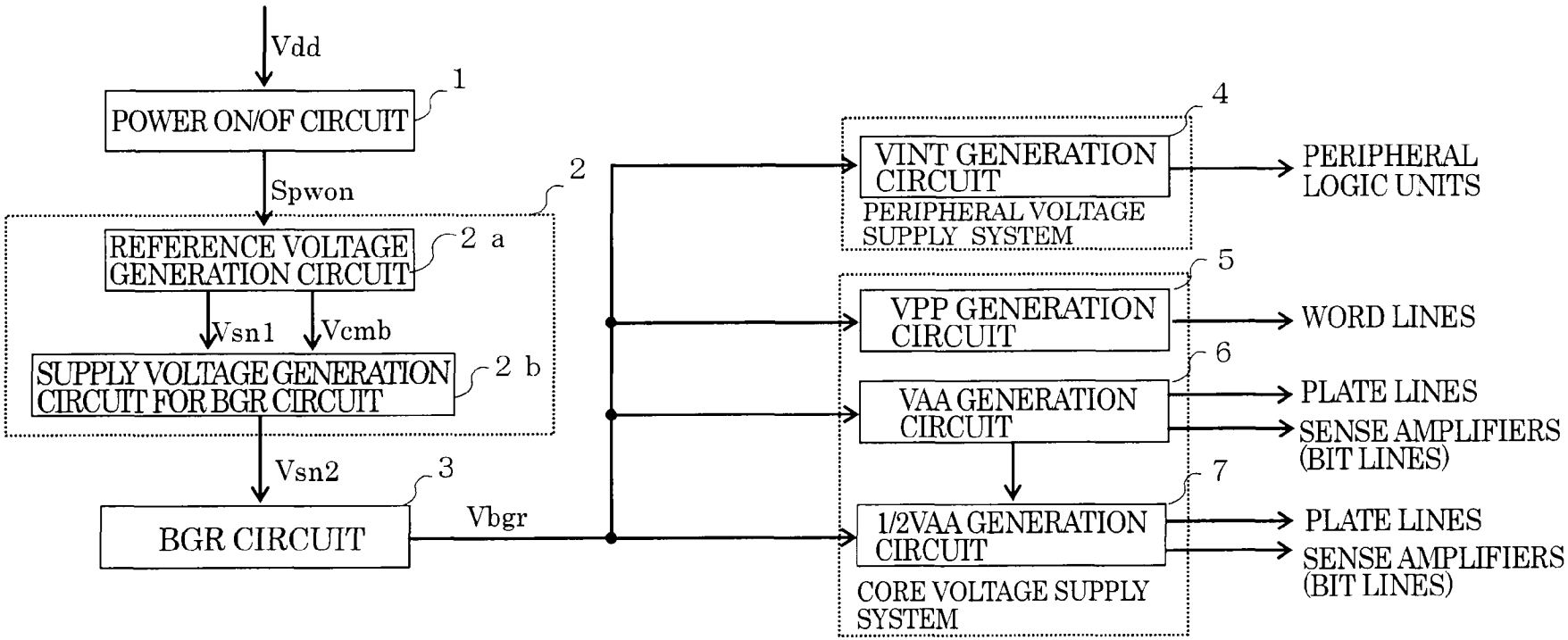
FIG. 1 is a block diagram showing a configuration of a power supply circuit of a semiconductor memory device according to a first embodiment of the present invention.
Figure 2:
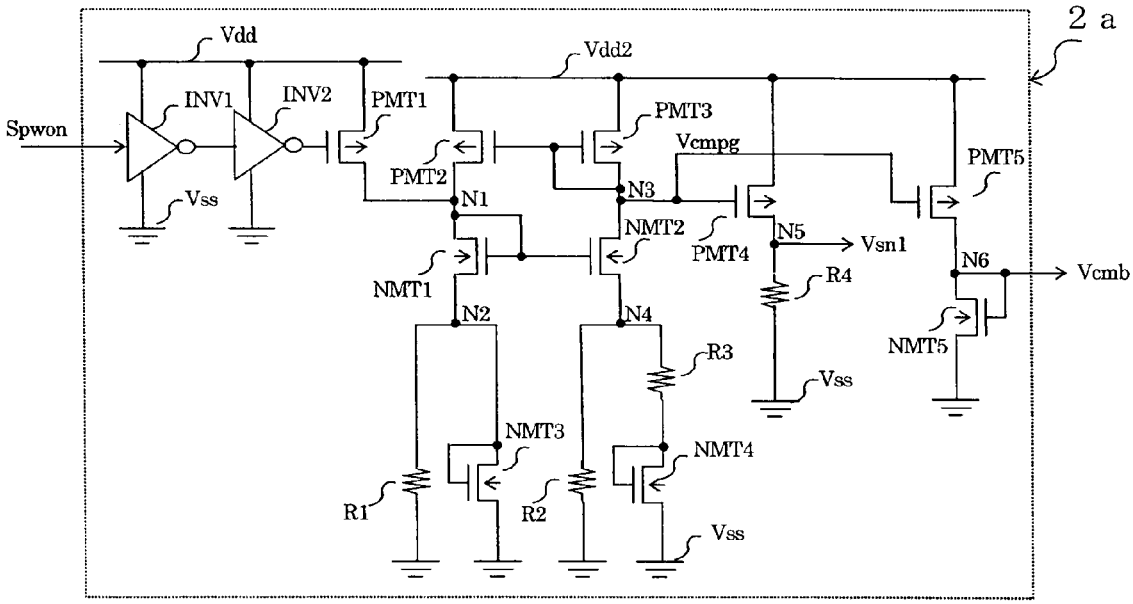
FIG. 2 is circuit diagram showing a reference voltage generation circuit of the first embodiment.
Figure 3:
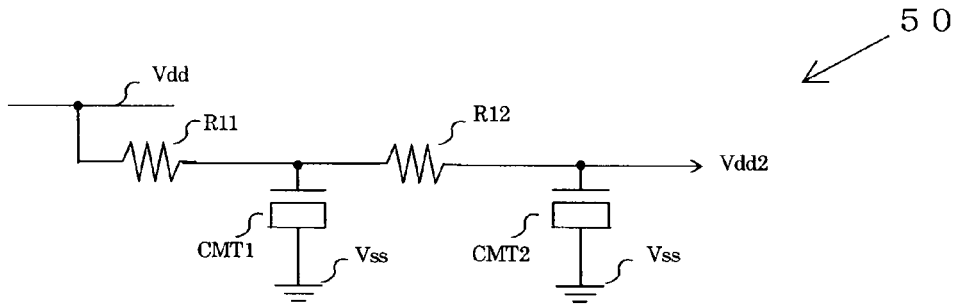
FIG. 3 is a circuit diagram showing an internal higher voltage supply unit of the first embodiment.
Figure 4:
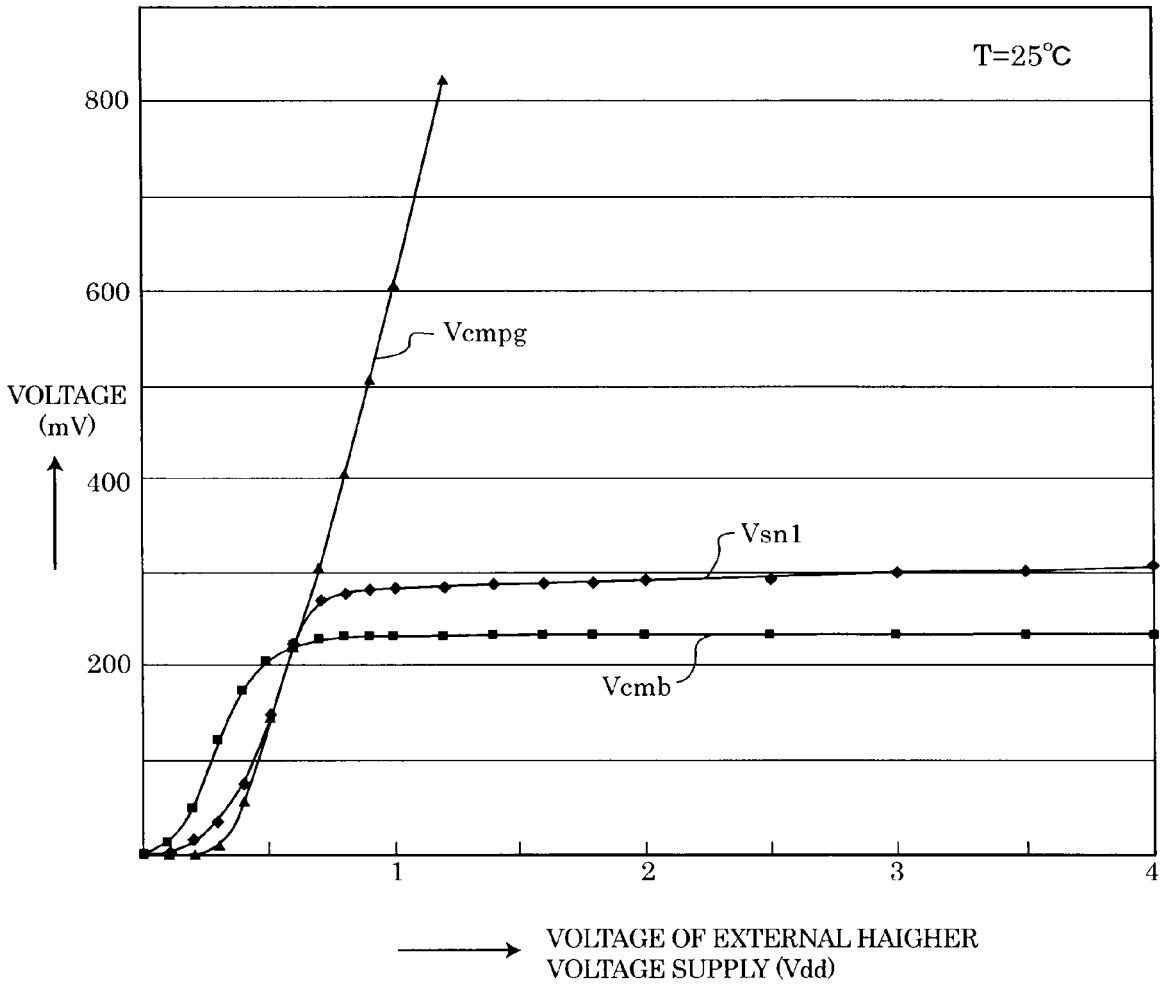
FIG. 4 is a graph showing characteristics of voltages generated by the reference voltage generation circuit of FIG. 2.
Figure 5:
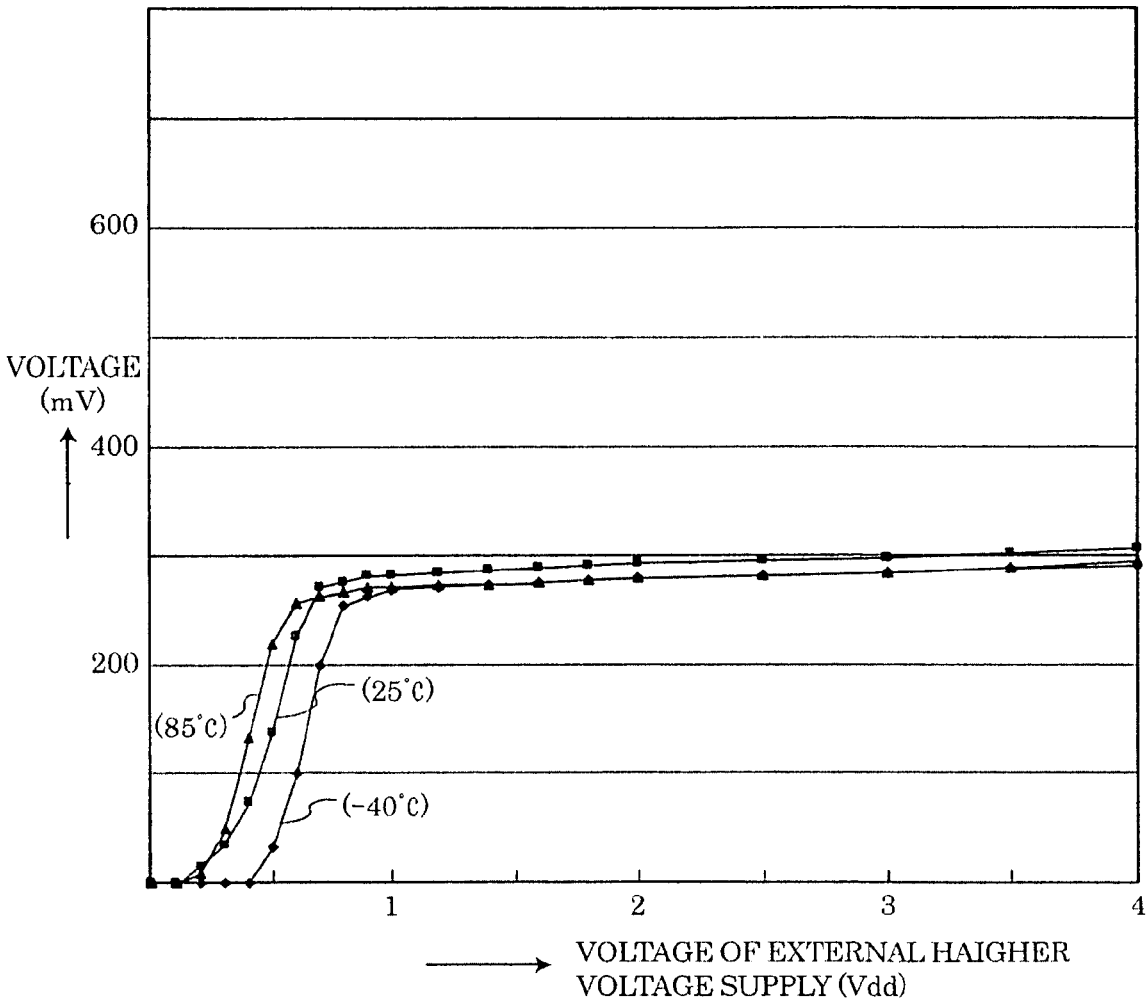
FIG. 5 is a graph showing temperature characteristics of reference voltages generated by the reference voltage generation circuit of FIG. 2.
Figure 6:
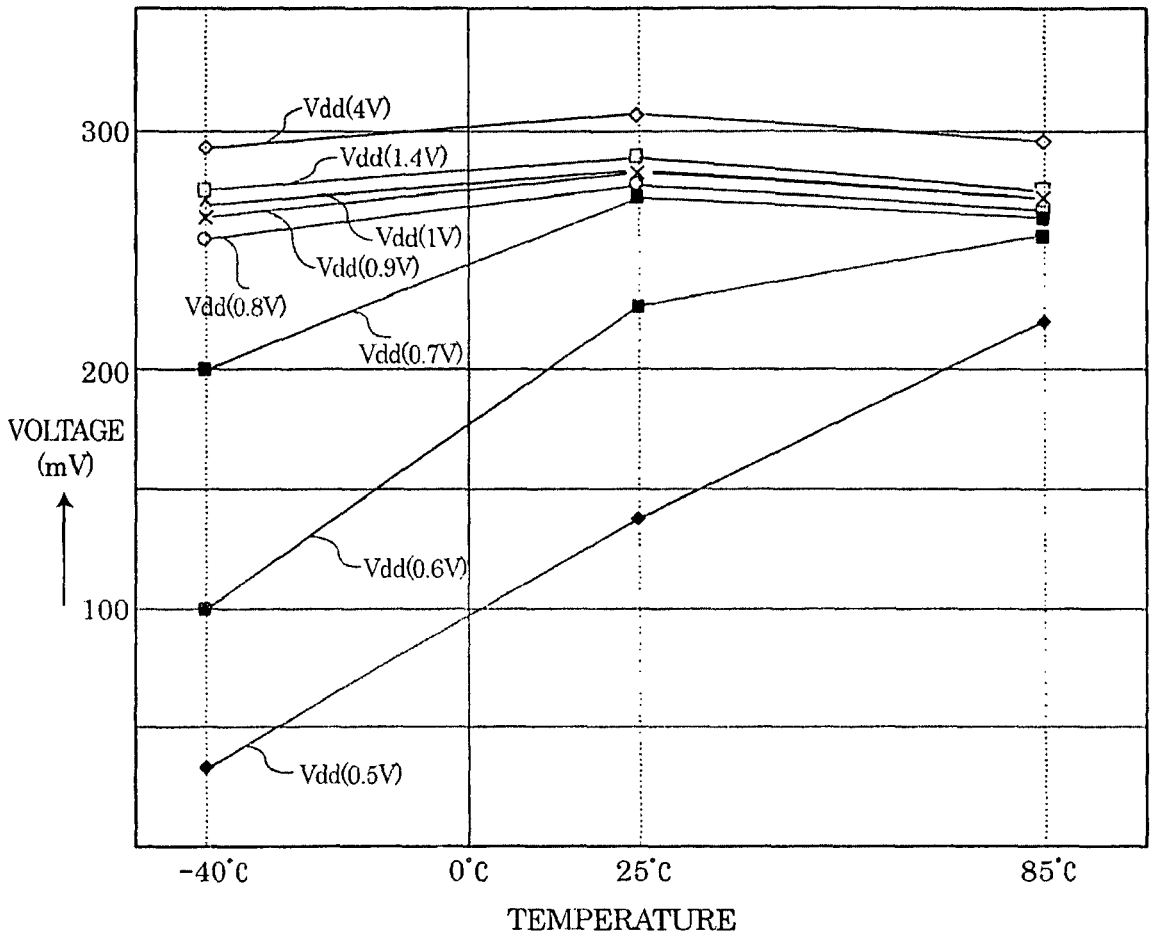
FIG. 6 is a graph showing dependency of reference voltages of the reference voltage generation circuit of FIG. 2 on a voltage of an external power supply.
Figure 7:
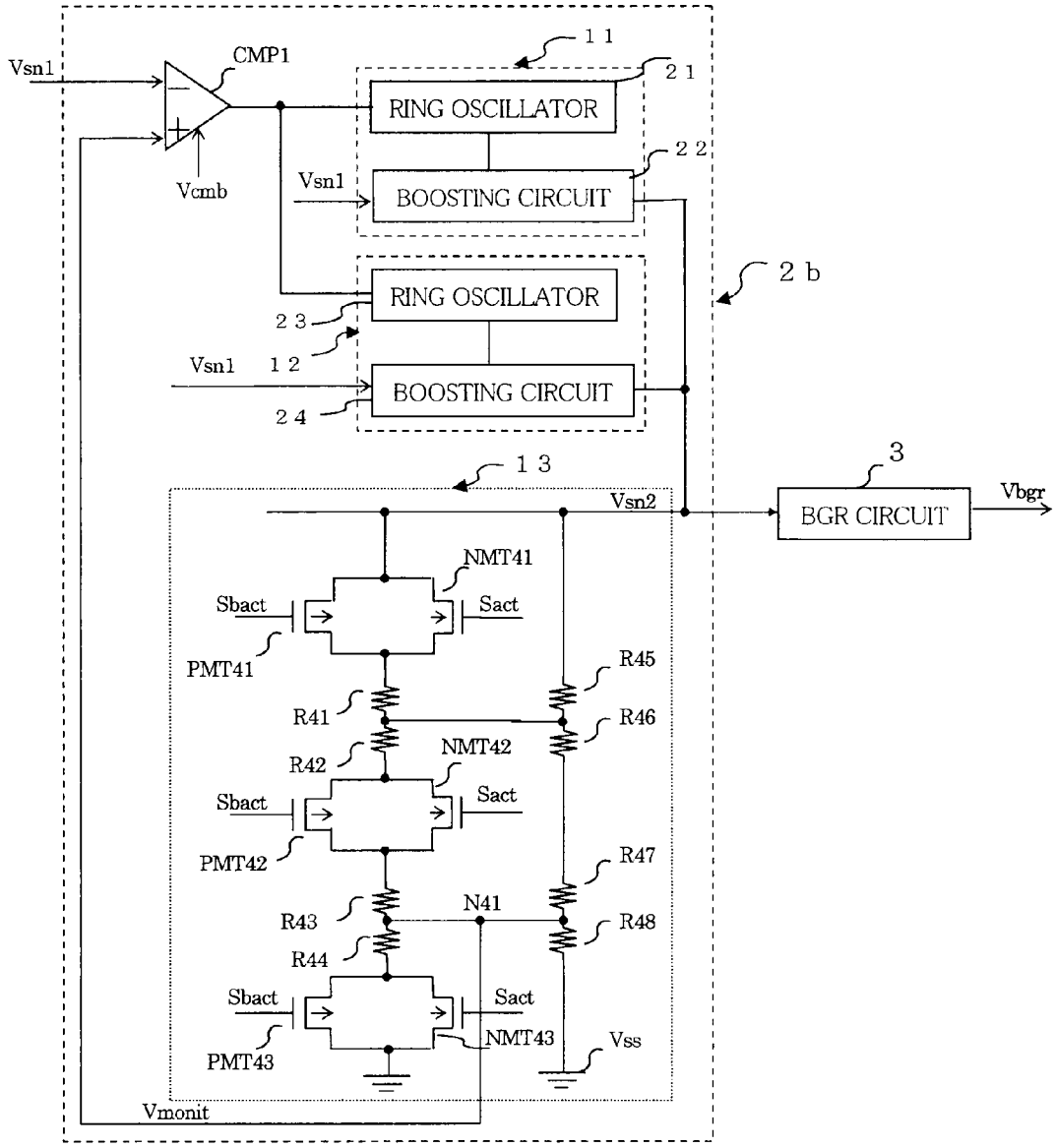
FIG. 7 is a circuit diagram showing a power supply voltage generation circuit for bandgap reference circuit of the first embodiment.
Figure 8:
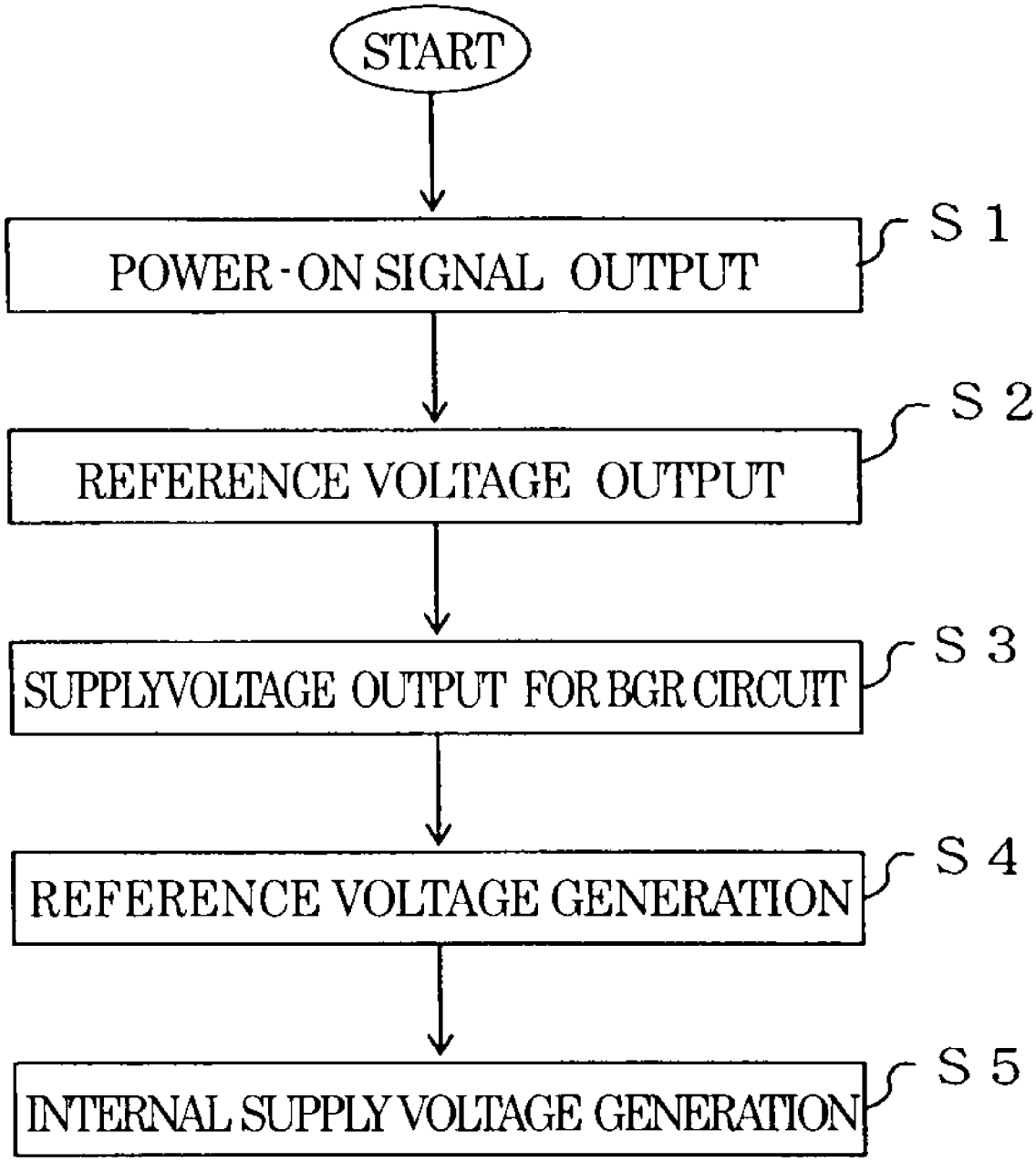
FIG. 8 is a flowchart showing steps of generating an internal power supply voltage of the first embodiment.

A first embodiment of the present invention will be described with reference to drawings. FIG. 1 is a block diagram showing a configuration of a power supply circuit of a semiconductor memory device according to the first embodiment of the present invention. FIG. 2 is circuit diagram showing a reference voltage generation circuit of the embodiment. FIG. 3 is a circuit diagram showing a higher voltage supply unit of the embodiment. FIG. 4 is a graph showing characteristics of voltages generated by the reference voltage generation circuit at room temperature of 25 degrees Celsius. FIG. 5 is a graph showing temperature characteristics of reference voltages of the reference voltage generation circuit. FIG. 6 is a graph showing dependency of reference voltages of the reference voltage generation circuit on a voltage of an external power supply. FIG. 7 is a circuit diagram showing a power supply voltage generation circuit for a bandgap reference circuit (hereinafter, referred to as a "BGR" circuit) of the embodiment. FIG. 8 is a flowchart showing steps of generating an internal power supply voltage of the embodiment.

As shown in FIG. 1, a power supply circuit 40 of the embodiment includes a power ON/OFF circuit 1, a power supply voltage generator 2 for BGR circuit, a bandgap reference circuit (BGR circuit) 3, a VINT generation circuit 4, a VPP generation circuit 5, a VAA generation circuit 6, and a ½ VAA generation circuit 7. The power supply circuit 40 receives a voltage of an external higher voltage supply Vdd, and generates various internal power supply voltages necessary for operations of a semiconductor memory device. The higher voltage supply Vdd represents an external higher voltage supply.

A voltage of the external higher voltage supply Vdd is inputted to the power ON/OFF circuit 1. When the voltage of the external higher voltage supply Vdd rises and reaches a predetermined voltage or more, a power ON signal Spwon is generated.

The power supply voltage generation unit 2 for BGR circuit is provided with a reference voltage generation circuit 2*a* and a power supply voltage generation circuit 2*b* for BGR circuit. The reference voltage generation circuit 2*a* receives the power ON signal Spwon and generates a reference voltage Vsn1 and a control voltage Vcmb. The reference voltage Vsn1 and the control voltage Vcmb are inputted into the power supply voltage generation circuit 2*b* for BGR circuit. With these inputs, the power supply voltage generation circuit 2*b* for BGR circuit generates a power supply voltage for BGR circuit Vsn2. Specific configurations and operations of the reference voltage generation circuit 2*a* and the power supply voltage generation circuit 2*b* for BGR circuit will be described later.

The bandgap reference circuit 3 serves as a reference voltage generation circuit. The power supply voltage Vsn2 for BGR circuit is inputted into the bandgap reference circuit 3. The bandgap reference circuit 3 uses the voltage Vsn2 as a power supply voltage so as to generate a reference voltage Vbgr, i.e. a base voltage.

The bandgap reference circuit 3 outputs reference voltages to the VINT generation circuit 4, the VPP generation circuit 5, the VAA generation circuit 6, and the ½ VAA generation circuit 7. The bandgap reference circuit 3 is configured such that the reference voltage Vbg has very small temperature dependency and very small power supply voltage dependency. The reference voltage Vbgr may be constant at a voltage of 1.21 V, for example.

The reference voltage Vbgr is inputted into the VINT generation circuit 4 serving as a peripheral voltage supply system. On the basis of the reference voltage Vbgr, the VINT generation circuit 4 generates a VINT voltage and supplies the generated VINT voltage to peripheral logic units.

The reference voltage Vbgr is inputted into the VPP generation circuit 5 serving as a core voltage supply system. On the basis of the reference voltage Vbgr, the VPP generation circuit 5 generates a VPP voltage and supplies the generated VPP voltage to word lines of a memory unit (not shown). The reference voltage Vbgr is inputted into the VAA generation circuit 6 serving as a core voltage supply system. On the basis of the reference voltage Vbgr, the VAA generation circuit 6 generates a VAA voltage and supplies the generated VAA voltage to a plate lines and sense amplifiers (bit lines) of the memory unit. The reference voltage Vbgr is inputted into the ½ VAA generation circuit 7. On the basis of the reference voltage Vbgr thus received, the ½ VAA generation circuit 7 generates a ½ VAA voltage and supplies the generated ½ VAA voltage to the bit lines (the sense amplifiers) and the plate lines of the memory unit. A description of supplying voltage to another power supply circuit such as a power supply circuit for dummy capacitor will be omitted.

As shown in FIG. 2, the reference voltage generation circuit 2*a* is provided with inverters INV1, INV2, N-channel MOS transistors NMT1 to NMT5 and P-channel MOS transistors PMT1 to PMT5, and resistors R1 to R5. The N-channel MOS transistors NMT1 to NMT5 and P-channel MOS transistors PMT1 to PMT5 are insulated-gate field-effect transistors. The MOS transistors used in the embodiment are of normally-off type (also referred to as enhancement type or E type).

The inverter INV1 is connected between the external higher voltage supply Vdd and a lower voltage supply (ground potential) Vss. In other words, the inverter INV 1 is connected between connection means such as wiring and terminals included in the power supply circuit 40 for connecting with the external higher voltage supply Vdd, and connection means such as wiring and terminals included in the power supply circuit 40 for connecting with the lower voltage supply (ground potential) Vss.

Hereinafter, "being connected to the external higher voltage supply Vdd" means "being connected to connection means for establishing connection with the external higher voltage supply Vdd". Further, "being connected to the lower voltage supply (ground potential) Vss" means "being connected to connection means for establishing connection with the lower voltage supply (ground potential) Vss".

The power ON signal Spwon is inputted into the inverter INV1. The inverter INV 1 outputs an inverted signal of the power ON signal Spwon. The inverter INV2 is connected between the external higher voltage supply Vdd and the lower voltage supply (ground potential) Vss. The inverter INV2 is connected between the external higher voltage supply Vdd and the lower voltage supply (ground potential) Vss. A signal outputted from the inverter INV1 is inputted into the inverter INV2. The inverter INV2 outputs an inverted signal of the signal outputted from the inverter INV1. The source of the P-channel MOS transistor PMT1 is connected to the external higher voltage supply Vdd. A signal outputted from the inverter INV2 is inputted into the gate of the P-channel MOS transistor PMT1. The drain of the P-channel MOS transistor PMT1 is connected to a node N1.

The source of the P-channel MOS transistor PMT2 is connected to a higher voltage supply Vdd2. The drain of the P-channel MOS transistor PMT2 is connected to the node N1. A voltage of the higher voltage supply Vdd2 is generated by an internal higher voltage supply unit 50 shown in FIG. 3. The internal higher voltage supply unit 50 is an internal higher voltage supply provided to the inside of the power supply circuit of the semiconductor memory device.

The internal higher voltage supply unit 50 is provided with MOS transistor type capacitors CMT1, CMT2, and resistors R11, R12.

In FIG. 3, one end of the resistor R11 is connected to the higher voltage supply Vdd. One end (on a gate side) of the MOS transistor type capacitor CMT1 is connected to the other end of the resistor R11. The other end of the MOS transistor type capacitor CMT1 is connected to the lower voltage supply (ground potential) Vss. One end of the resistor R12 is connected to the other end of the resistor R11 and the one end of the MOS transistor type capacitor CMT1. One end (on a gate side) of the MOS transistor type capacitor CMT2 is connected to the other end of the resistor R12.

The other end of the MOS transistor type capacitor CMT2 is connected to the lower voltage supply (ground potential) Vss. A voltage of the higher voltage supply Vdd2 is outputted from the other end of the resistor R12 and the one end of the MOS transistor type capacitor CMT2. The higher voltage supply unit 50 is capable of generating a stable voltage of the higher voltage supply Vdd2, even when a voltage of the higher voltage supply Vdd serving as an external power supply fluctuates.

In FIG. 2, the source of the P-channel MOS transistor PMT3 is connected to the higher voltage supply Vdd2. The gate of the P-channel MOS transistor PMT3 is connected to the drain of the P-channel MOS transistor PMT3 and the gate of the P-channel MOS transistor PMT2. The drain of the P-channel MOS transistor PMT3 is connected to a node N3. A control voltage Vcmpg is outputted from the node N3 (the drain of the P-channel MOS transistor PMT3).

The source of the P-channel MOS transistor PMT4 is connected to the higher voltage supply Vdd2. The gate of the P-channel MOS transistor PMT4 is connected to the drain (node N3) of the P-channel MOS transistor PMT3. The drain of the P-channel MOS transistor PMT4 is connected to a node N5. A reference voltage Vsn1 is outputted from the node N5 (drain of the P-channel MOS transistor PMT4).

The source of the P-channel MOS transistor PMT5 is connected to the higher voltage supply Vdd2. The gate of the P-channel MOS transistor PMT5 is connected to the drain (node N3) of the P-channel MOS transistor PMT3 and the gate of the P-channel MOS transistor PMT4. The drain of the P-channel MOS transistor PMT5 is connected to a node N6. A control voltage Vcmb is outputted from the node N6 (the drain of the P-channel MOS transistor PMT5).

The drain of the N-channel MOS transistor NMT1 is connected to the node N1. The gate of the N-channel MOS transistor NMT1 is connected to the drain of the N-channel MOS transistor NMT1. The source of the N-channel MOS transistor NMT1 is connected to a node N2. The drain of the N-channel MOS transistor NMT2 is connected to the node N3. The gate of the N-channel MOS transistor NMT2 is connected to the gate of the N-channel MOS transistor NMT1. The source of the N-channel MOS transistor NMT2 is connected to a node N4.

One end of the resistor R1 is connected to the node N2. The other end of the resistor R1 is connected to the lower voltage supply (ground potential) Vss. The drain of the N-channel MOS transistor NMT3 is connected to the node N2. The gate of the N-channel MOS transistor NMT3 is connected to the drain of the N-channel MOS transistor NMT3. The N-channel MOS transistor NMT3 is a diode-connected MOS transistor. The source of the N-channel MOS transistor NMT3 is connected to the lower voltage supply (ground potential) Vss. One end of the resistor R2 is connected to the node N4. The other end of the resistor R2 is connected to the lower voltage supply (ground potential) Vss. One end of the resistor R3 is connected to the node N4. The drain of the N-channel MOS transistor NMT4 is connected to the other end of the resistor R3. The gate of the N-channel MOS transistor NMT4 is connected to the drain of the N-channel MOS transistor NMT4. The N-channel MOS transistor NMT4 is a diode-connected MOS transistor. The source of the N-channel MOS transistor NMT4 is connected to the lower voltage supply (ground potential) Vss.

One end of the resistor R4 is connected to the node N5. The other end of the resistor R4 is connected to the lower voltage supply (ground potential) Vss. The drain of the N-channel MOS transistor NMT5 is connected to the node N6. The gate of the N-channel MOS transistor NMT5 is connected to the drain of the N-channel MOS transistor NMT5. The N-channel MOS transistor NMT5 is a diode-connected MOS transistor. The source of the N-channel MOS transistor NMT5 is connected to the lower voltage supply (ground potential) Vss.

The P-channel MOS transistors PMT2 and PMT3 form a current mirror circuit. The N-channel MOS transistors NMT1 and NMT2 form a current mirror circuit. The P-channel MOS transistors PMT2 and PMT3 and the N-channel MOS transistors NMT1 and NMT2 form a Wilson constant current circuit.

The Wilson constant current circuit generates a stable current. Specifically, when a first current flows on the sides of the P-channel MOS transistor PMT2 and the N-channel MOS transistor NMT1, the first current is mirrored to the sides of the P-channel MOS transistor PMT3 and the N-channel MOS transistor NMT2 so that a stable second current flows through the P-channel MOS transistor PMT3 and the N-channel MOS transistor NMT2.

A threshold voltage Vtha of the N-channel MOS transistor NMT3, a threshold voltage Vthb of the N-channel MOS transistor NMT4, a threshold voltage Vthc of the N-channel MOS transistors NMT1 and NMT2, and a forward voltage Vf of a pn diode are set as shown in the following formula.

$$Vtha, Vthb < Vthc < Vf \quad (1)$$

The N-channel MOS transistors NMT1 and NMT2 are those to be used for a peripheral logic circuit, for example. The N-channel MOS transistors NMT3 and NMT4 are transistors, the threshold voltages of the N-channel MOS transistors NMT3 and NMT4 being lower than those of the N-channel MOS transistors NMT1 and NMT2. Such N-channel MOS transistors having different threshold voltages may be obtained by changing an ion implantation condition at the time of manufacturing the N-channel MOS transistors.

A gate width Wg1 and a gate length Lg1 of the N-channel MOS transistor NMT3, a gate width Wg2 and a gate length Lg2 of the N-channel MOS transistor NMT4, the resistors R1 to R3, and a mirror ratio N (a ratio between the first current and the second current of the above Wilson constant current circuit) are set as shown in the following formulas. In these formulas, Wg/Lg represents a β ratio of transistors. "k" represents a Boltzmann constant. "q" represents an electric charge of an electron. |dVf/dT| represents the temperature dependency of the ON voltage of a pn diode.

$$R1=R2 \quad (2)$$

$$Wg1/Lg1:Wg2/Lg2=1:N \quad (3)$$

$$(R3/R2)\times(k/q)\times\ln(N)=|dVf/dT| \quad (4)$$

As shown in FIG. 4, voltages Vcmpg, Vsn1, and Vcmb to be generated by the reference voltage generation circuit 2*a*, which are set in accordance with the above described formulas (1) to (4), vary. FIG. 4 shows characteristics at room temperature T of 25 degrees Celsius. The control voltage Vcmpg increases linearly relative to the voltage of the external higher voltage supply Vdd when the voltage of the voltage supply Vdd is equal to or higher than 0.3 V. On the basis of the control voltage Vcmpg, the reference voltage Vsn1 increases relative to the voltage of the external higher voltage supply Vdd when the voltage of the voltage supply Vdd is from 0 V to 0.7 V, and the reference voltage Vsn1 becomes substantially saturated and becomes constant when the voltage of the voltage supply Vdd is higher than 0.7 V. Similarly, on the basis of the control voltage Vcmpg, the control voltage Vcmb increases relative to the voltage of the external higher voltage supply Vdd when the voltage of the voltage supply Vdd is from 0 V to 0.6 V, and the control voltage Vcmb becomes substantially saturated and becomes constant when the voltage of the voltage supply Vdd is higher than 0.6 V.

As shown in FIG. 5, as to the reference voltage Vsn1 to be outputted from the reference voltage generation circuit 2*a*, a voltage, which are saturated with respect to the voltage of the external higher voltage supply Vdd at a higher temperature (85 degrees Celsius), is lower than a saturation voltage at a room temperature (25 degrees Celsius). A voltage, which are saturated with respect to the voltage of the external higher voltage supply Vdd at a lower temperature (−40 degrees Celsius), is higher than a saturation voltage at the room temperature (25 degrees Celsius). Further, referring to FIG. 6, dependency of the voltage of the external higher voltage supply Vdd will be described with respect to the change in temperature of the reference voltage Vsn1.

FIG. 6 is a diagram showing dependency of the voltage of the external higher voltage supply Vdd with respect to the reference voltage Vsn1 to be outputted from the reference voltage generation circuit 2*a*. The reference voltage Vsn1 fluctuates largely with respect to the voltage of the external higher voltage supply Vdd at the time of the low temperature (−40 degrees Celsius). When the voltage of the external higher voltage supply Vdd is 0.7 V or less, the reference voltage Vsn1 decreases drastically. At the room temperature (25 degrees Celsius), the reference voltage Vsn1 decreases in a region where the voltage of the external higher voltage supply Vdd is 0.6 V or less. At the high temperature (85 degrees Celsius), the reference voltage Vsn1 decreases in a region where the voltage of the external higher voltage supply Vdd is 0.5 V or less.

It can be seen from the above results that the voltage of the external higher voltage supply Vdd is to be set to range from 0.8 V to 4 V. In the range, the reference voltage generation circuit 2*a* can generate a voltage as the reference voltage Vsn1 which has little dependency on the voltage of the external higher voltage supply Vdd. Further, the reference voltage generation circuit 2*a* can generate a voltage as the reference voltage Vsn1, which is substantially constant in the range from the low temperature (−40 degrees C.) to the high temperature (85 degrees C.).

FIG. 7 shows the power supply voltage generation circuit 2*b* for BGR circuit. The power supply voltage generation circuit 2*b* for BGR circuit is provided with a comparator CMP1, a boosting circuit unit for active state 11, a boosting circuit unit for standby state 12, and a monitor unit 13.

The reference voltage Vsn1 is inputted into a minus (−) port on an input side of the comparator CMP1. A monitor voltage Vmonit feedbacked from the monitor unit 13 is inputted into a plus (+) port on the input side of the comparator CMP1. The control voltage Vcmb for controlling a bias current is inputted into the comparator CMP1, the bias current driving the comparator CMP1. The comparator CMP1 compares the reference voltage Vsn1 and the monitor voltage Vmonit, and outputs an amplified signal of the difference between the reference voltage Vsn1 and the monitor voltage Vmonit.

The boosting circuit unit for active state 11 is provided with a ring oscillator for active state 21 operating at the time of an active state and a boosting circuit for active state 22. A signal outputted from the comparator CMP1 is inputted into the ring oscillator for active state 21. A signal outputted from the ring oscillator for active state 21 is inputted into the boosting circuit for active state 22. The boosting circuit for active state 22 generates a boosted power supply voltage for BGR circuit Vsn2.

The boosting circuit unit for standby state 12 is provided with a ring oscillator for standby state 23 operating at the time of a standby state and a boosting circuit for standby state 24. A signal outputted from the comparator CMP1 is inputted into the ring oscillator for standby state 23. A signal outputted from the ring oscillator for standby state 23 is inputted into the boosting circuit for standby state 24. The boosting circuit for standby state 24 generates a boosted power supply voltage for BGR circuit Vsn2.

The power supply voltage for BGR circuit Vsn2 is higher than the reference voltage Vsn1 and the reference voltage Vbgr, and is substantially a constant voltage (2 V, for example) to the voltage of the external higher voltage supply Vdd. It is possible to keep the power supply voltage for BGR circuit Vsn2 higher than 2 V even when the voltage of the external higher voltage supply Vdd is on the order of 1 V.

The monitor unit 13 is provided with P-channel MOS transistors PMT41 to PMT43, N-channel MOS transistors NMT41 to NMT43, and resistors R41 to R48. The monitor unit 13 monitors the power supply voltage for BGR circuit Vsn2 and generates the monitor voltage Vmonit.

The power supply voltage for BGR circuit Vsn2 is inputted into the drain of the N-channel MOS transistor NMT41. A control signal Sact is inputted into the gate of the N-channel MOS transistor NMT41. The power supply voltage for BGR circuit Vsn2 is inputted into the source of the P-channel MOS transistor PMT41. A control signal Sbact is inputted into the gate of the P-channel MOS transistor PMT41. The control signal Sbact has a phase opposite to that of the control signal Sact. The N-channel MOS transistor NMT41 and the P-channel MOS transistor PMT41 function as transfer gates, and are turned "ON" when the control signal Sact is at "High" level (the control signal Sbact is at "Low" level).

One end of the resistor R41 is connected to the source of the N-channel MOS transistor NMT41 and the drain of the P-channel MOS transistor PMT41. One end of the resistor R42 is connected to the other end of the resistor R41.

The drain of the N-channel MOS transistor NMT42 is connected to the other end of the resistor R42. The control signal Sact is inputted into the gate of the N-channel MOS transistor NMT42. The source of the P-channel MOS transistor PMT42 is connected to the other end of the resistor R42. The control signal Sbact is inputted into the gate of the P-channel MOS transistor PMT42. The N-channel MOS transistor NMT42 and the P-channel MOS transistor PMT42 function as transfer gates, and are turned "ON" when the control signal Sact is at "High" level (the control signal Sbact is at "Low" level).

One end of the resistor R43 is connected to the source of the N-channel MOS transistor NMT42 and the drain of the P-channel MOS transistor PMT42. One end of the resistor R44 is connected to the other end of the resistor R43.

The drain of the N-channel MOS transistor NMT43 is connected to the other end of the resistor R44. The control signal Sact is inputted into the gate of the N-channel MOS transistor NMT43. The source of the N-channel MOS transistor NMT43 is connected to the lower voltage supply (ground potential) Vss. The source of the P-channel MOS transistor PMT43 is connected to the other end of the resistor R44. The control signal Sbact is inputted into the gate of the P-channel MOS transistor PMT43. The drain of the P-channel MOS transistor PMT43 is connected to the lower voltage supply (ground potential) Vss.

The N-channel MOS transistor NMT43 and the P-channel MOS transistor PMT43 function as transfer gates, and are turned "ON" when the control signal Sact is at "High" level (the control signal Sbact is at "Low" level).

The power supply voltage for BGR circuit Vsn2 is inputted into one end of the resistor R45. The other end of the resistor R45 is connected to the other end of the resistor R41 and the one end of the resistor R42. One end of the resistor R46 is connected to the other end of the resistor R45.

One end of the resistor R47 is connected to the other end of the resistor R46. The other end of the resistor R47 is connected to the other end of the resistor R43 and the one end (node N41) of the resistor R44. One end of the resistor R48 is connected to the other end of the resistor R47. The other end of the resistor R48 is connected to the lower voltage supply (ground potential) Vss. The monitor voltage Vmonit as a resistively divided feedback voltage is inputted into the plus (+) port on the input side of the comparator CMP1 from the node N41.

Steps of generating an internal power supply voltage by the power supply voltage generation circuit 2*b* will be described with reference to FIG. 8. FIG. 8 is a flowchart showing steps of generating the internal power supply voltage.

In FIG. 1, when the external higher voltage supply Vdd is inputted into the power supply circuit 40 of the semiconductor memory device, a voltage level of the external higher voltage supply Vdd is checked in the power ON/OFF circuit 1. When the voltage of the external higher voltage supply Vdd rises and reaches a predetermined voltage or more, a power ON signal Spwon is outputted to the power supply voltage generation unit 2 for BGR circuit (Step S1 in FIG. 8).

In FIG. 2, the reference voltage generation circuit 2*a* is started using the power ON signal Spwon, the voltage of the external higher voltage supply Vdd and the voltage of the higher voltage supply Vdd2 generated by the higher voltage supply unit 50 in FIG. 3. This start-up generates the control voltage Vcmb, and the reference voltage Vsn1 having small temperature and power supply voltage dependencies and having a substantially constant voltage level (Step S2 of FIG. 8).

Subsequently, as shown in FIGS. 1 and 7, the reference voltage Vsn1 and the control voltage Vcmb are inputted into the comparator CMP1 operating at low power consumption in the reference voltage generation circuit 2*a*. With a signal outputted from the comparator CMP1, the ring oscillator and the boosting circuit of FIG. 7 are started to operate. Even when the voltage of the higher voltage supply Vdd2 is as low level as substantially 1 V, the power supply voltage for BGR circuit Vsn2 which is 2 V, for example, is generated (Step S3 of FIG. 8).

The voltage Vsn2 being higher than the reference voltage Vsn1 and the reference voltage Vbgr.

In FIG. 1, the power supply voltage for BGR circuit Vsn2 is inputted into the bandgap reference circuit (BGR circuit) 3. In the bandgap reference circuit 3, the power supply voltage for BGR circuit Vsn2 is used as a power supply voltage, and the reference voltage Vbgr having very small temperature and power supply voltage dependencies and having a constant voltage level of 1.21 V, for example, is generated (Step S4 of FIG. 8).

In FIG. 1, the reference voltage Vbgr outputted from the bandgap reference circuit 3 is outputted to the VINT generation circuit 4 being a peripheral voltage supply system, the VPP generation circuit 5 being a core voltage supply system, the VAA generation circuit 6, and the ½ VAA generation circuit 7.

In the VINT generation circuit 4, the VPP generation circuit 5, the VAA generation circuit 6, and the ½ VAA generation circuit 7, internal power supply voltages are respectively generated (Step S5 of FIG. 8) on the basis of the reference voltage Vbgr.

As described above, even when voltages of a power supply circuit ha and the external higher voltage supply Vdd of the embodiment are low, it is possible to cause the bandgap reference circuit 3 to generate a desired reference voltage Vbgr and to generate internal power supply voltages.

Figure 9:
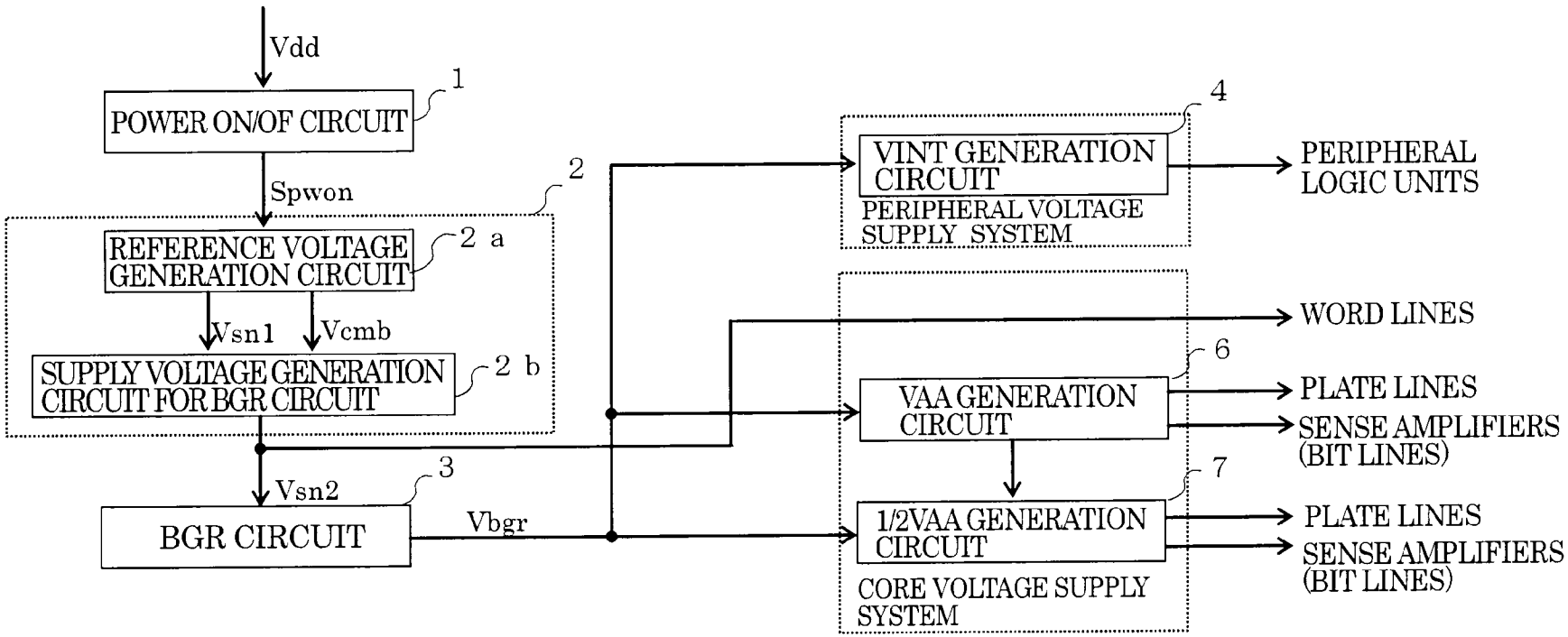
FIG. 9 is a block diagram showing a configuration of a power supply circuit of a semiconductor memory device according to a second embodiment of the present invention.

A power supply circuit of a semiconductor memory device according to a second embodiment of the present invention will be described with reference to drawings. FIG. 9 is a block diagram showing a configuration of the power supply circuit of the semiconductor memory device according to the second embodiment of the present invention.

In FIG. 9, the same portions as those in FIG. 1 are denoted by the same reference numerals.

In FIG. 9, as in the first embodiment, a power supply circuit 40*a* is provided with a power ON/OFF circuit 1, a power supply voltage generation unit 2 for BGR circuit, a bandgap reference circuit 3, a VINT generation circuit 4, a VAA generation circuit 6, and a ½ VAA generation circuit 7.

A voltage of an external higher voltage supply Vdd as an external power source is inputted into the power supply circuit 40*a*, and the power supply circuit 40*a* thereby generates various internal power supply voltages necessary for operations of the semiconductor memory device.

The power supply voltage generation unit 2 for BGR circuit is provided with a reference voltage generation circuit 2*a* and a power supply voltage generation circuit 2*b* for BGR circuit. A power ON signal Spwon is inputted into the reference voltage generation circuit 2*a*. The reference voltage generation circuit 2*a* generates a reference voltage Vsn1 and a control voltage Vcmb. The reference voltage Vsn1 and the control voltage Vcmb are inputted into the power supply voltage generation circuit 2*b* for BGR circuit. The power supply voltage generation circuit 2*b* for BGR circuit generates a power supply voltage for BGR circuit Vsn2. The power supply voltage for BGR circuit Vsn2 is outputted to the bandgap reference circuit 3 and is supplied to word lines of the semiconductor memory device as a VPP voltage.

The VPP voltage causes transfer gates of cells of the semiconductor memory device to be turned ON or OFF, and signal voltages of the cells do not directly depend on the VPP voltage. Accordingly, the power supply voltage for BGR circuit Vsn2 having power supply voltage dependency is used as the VPP voltage being a boosting voltage of word lines so as to enable transfer gates of memory cells to be turned ON or OFF.

As described above, in the power supply circuit of the embodiment, the power supply voltage for BGR circuit Vsn2 can be supplied to a word line WL of the semiconductor memory device as the VPP voltage without using the VPP generation circuit.

Accordingly, the second embodiment shows another advantage of reducing the number of internal power supply generating circuits in addition to the advantages of the first embodiment.

A power supply circuit of a semiconductor memory device according to a third embodiment of the present invention will be described with reference to FIG. 10. A schematic configuration of the power supply circuit of the semiconductor memory device of the third embodiment is the same as that of FIG. 1 or FIG. 9.

Figure 10:
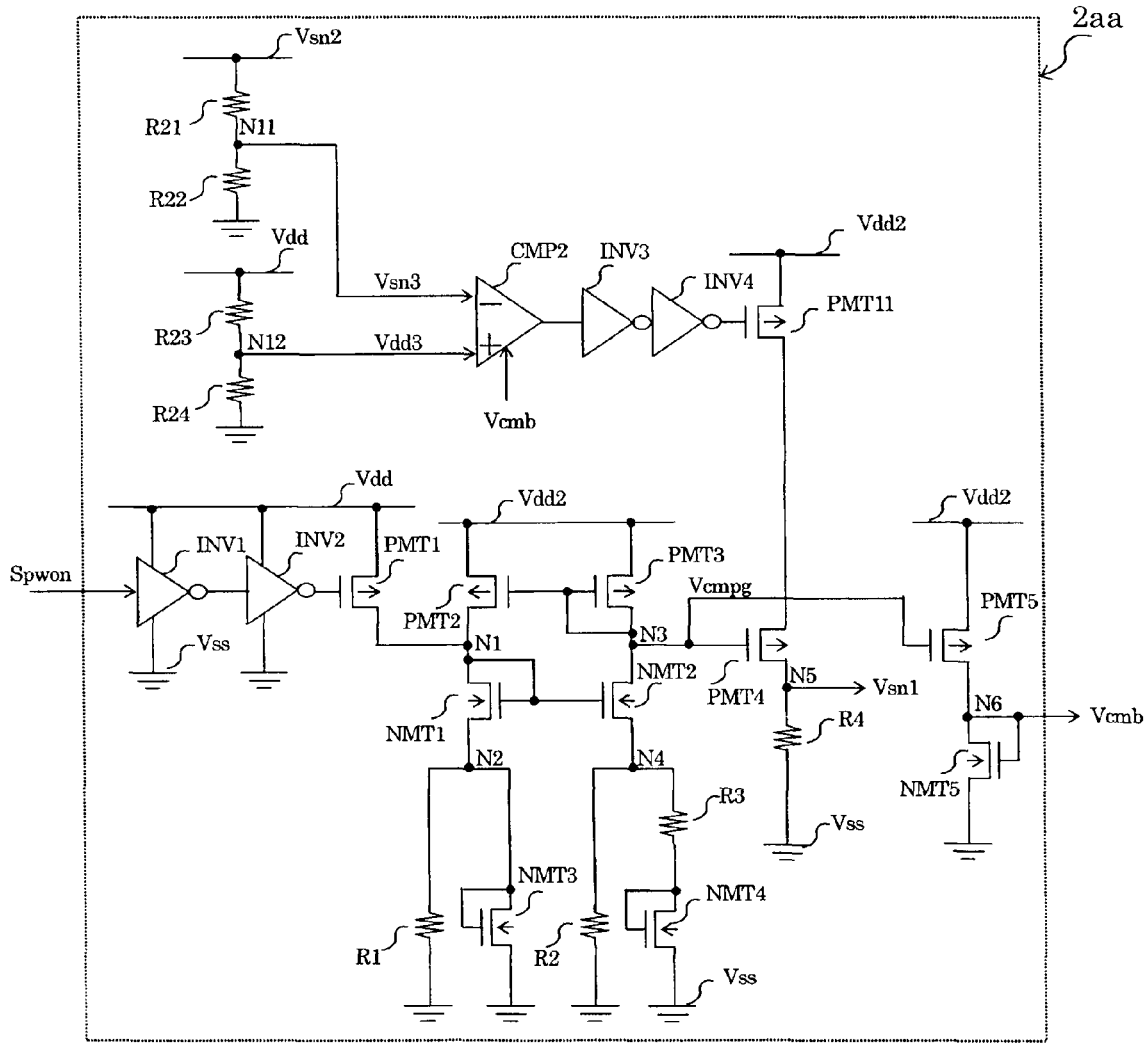
FIG. 10 is a circuit diagram showing a reference voltage generation circuit of a power supply circuit according to a third embodiment of the present invention.
Figure 11:
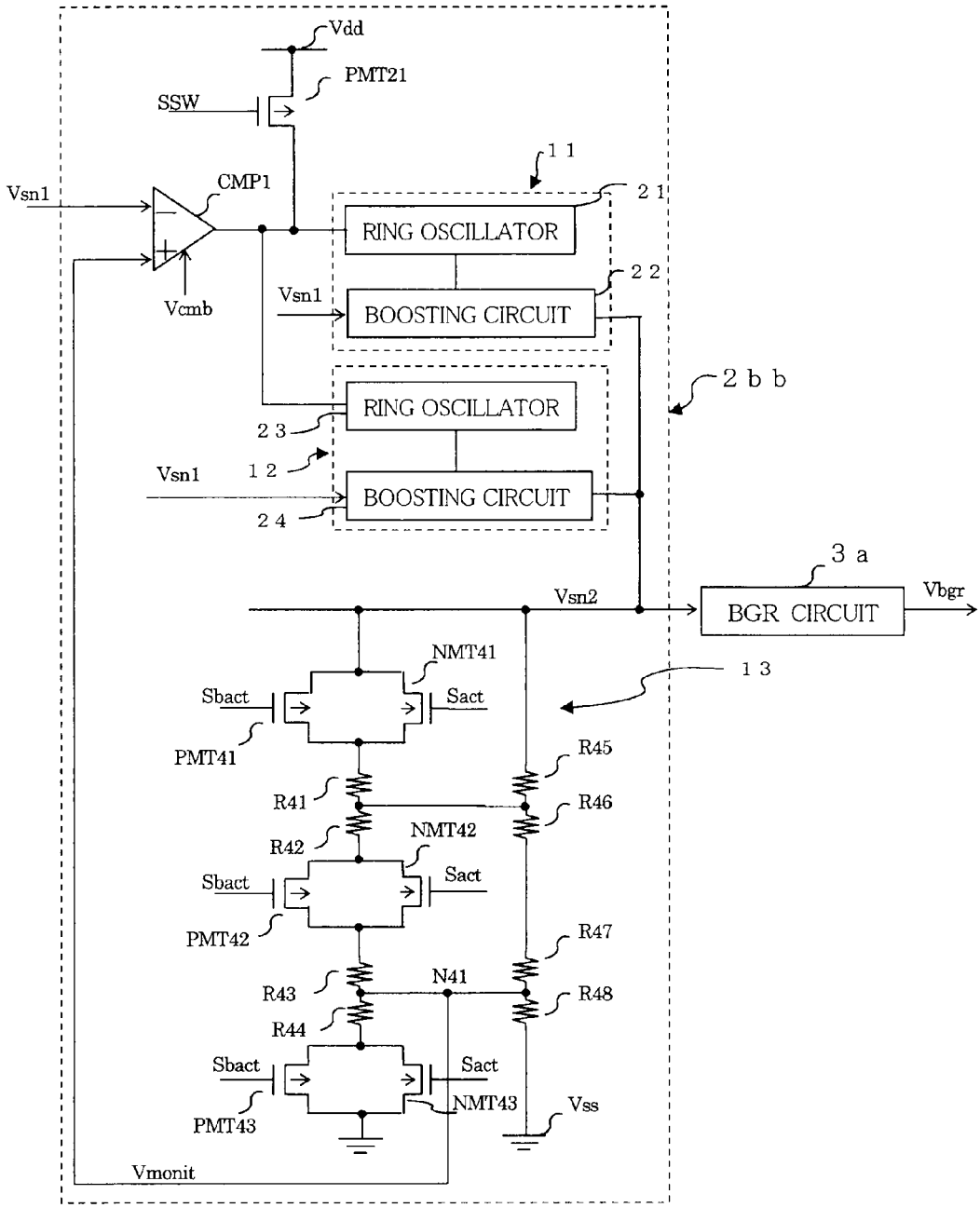
FIG. 11 is a circuit diagram showing a power supply voltage generation circuit for bandgap reference circuit employed in the power supply circuit according to the third embodiment.
Figure 12:
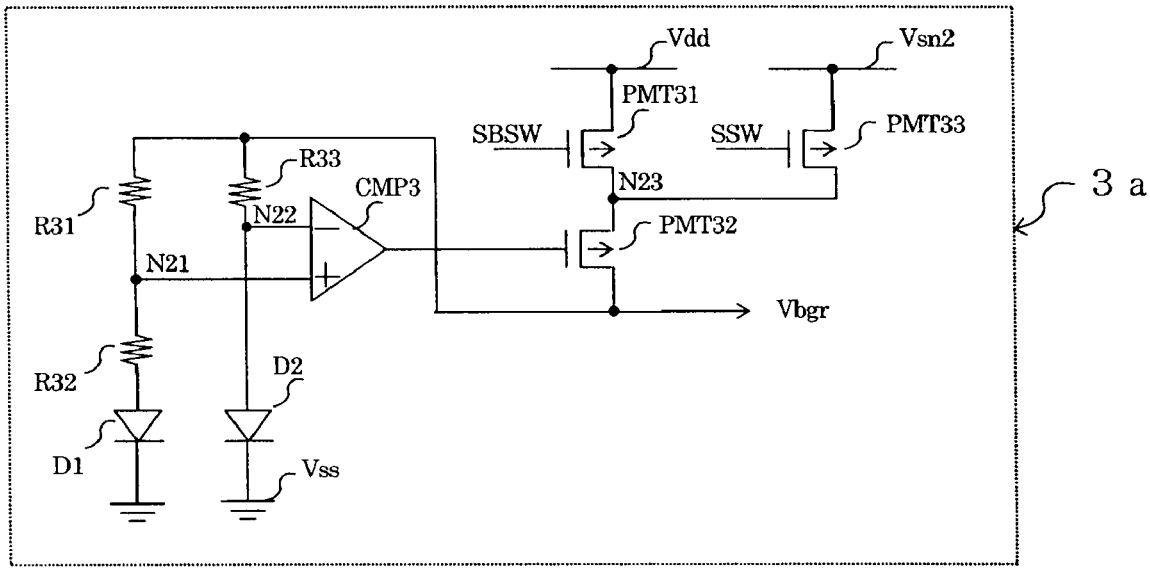
FIG. 12 is a circuit diagram showing a bandgap reference circuit.

FIG. 10 is a circuit diagram showing a reference voltage generation circuit to be used in the embodiment. FIG. 11 is a circuit diagram showing a power supply voltage generation circuit for BGR circuit to be used in the embodiment. FIG. 12 is a circuit diagram showing a bandgap reference circuit to be used in the embodiment. In FIGS. 10 to 12, the same portions as those in FIGS. 1, 2, 7, and 9 are denoted by the same reference numerals.

In FIG. 10, a reference voltage generation circuit 2*aa* is provided with a comparator CMP2, inverters INV1 to INV4, N-channel MOS transistors NMT1 to NMT5, P-channel MOS transistors PMT1 to PMT5, a P-channel MOS transistor PMT11, resistors R1 to R6, and resistors R21 to R24. In the embodiment, a normally-off type (also referred to as enhancement type or an E type) MOS transistor is used as a MOS transistor.

The reference voltage generation circuit 2*aa* operates with a power ON signal Spwon in the same way as the reference voltage generation circuit 2*a* of the first embodiment. The reference voltage generation circuit 2*aa* generates a reference voltage Vsn1, a control voltage Vcmpg, and a control voltage Vcmb. When the P-channel MOS transistor PMT11 is turned OFF, the reference voltage generation circuit 2*aa* does not generate the reference voltage Vsn1. The P-channel MOS transistor PMT11 is turned off by providing a second voltage higher than a first voltage, which enables outputting a power ON signal Spwon, to the gate of the P-channel MOS transistor PMT11.

One end of the resistor R21 is connected to a power supply for BGR circuit Vsn2 to be described in FIG. 11. The other end of the resistor R21 is connected to a node N11. One end of the resistor R22 is connected to the node N11. The other end of the resistor R22 is connected to a lower voltage supply (ground potential) Vss. A reference voltage Vsn3 being a resistively divided voltage is outputted from the node N11.

One end of the resistor R23 is connected to the external higher voltage supply Vdd. The other end of the resistor R23 is connected to a node N12. One end of the resistor R24 is connected to the node N12. The other end of the resistor R24 is connected to the lower voltage supply (ground potential) Vss. A voltage of the higher voltage supply Vdd3 being a resistively divided voltage is outputted from the node N12.

A third reference voltage Vsn3 is inputted into a minus (−) port on an input side of the comparator CMP2. A voltage of the higher voltage supply Vdd3 is inputted into a plus (+) port on the input side of the comparator CMP2. The control voltage Vcmb controlling a bias current of the comparator CMP2 is supplied to the comparator CMP2. The comparator CMP2 compares the reference voltage Vsn3 and the voltage of the higher voltage supply Vdd3, and outputs an amplified signal of the difference between the reference voltage Vsn3 and the voltage of the higher voltage supply Vdd3.

A signal outputted from the comparator CMP2 is inputted into the inverter INV3, and the inverter INV3 outputs an inverted signal. A signal outputted from the inverter INV3 is inputted into the inverter INV4, and the inverter INV4 outputs an inverted signal.

The source of the P-channel MOS transistor PMT11 is connected to the higher voltage supply Vdd2. A signal outputted from the inverter INV4 is inputted into the gate of the P-channel MOS transistor PMT11. The drain of the P-channel MOS transistor PMT11 is connected to the node N1. When a signal outputted from the comparator CMP2 is minus (−), the P-channel MOS transistor PMT11 is turned ON, and when a signal outputted from the comparator CMP2 is plus (+), the P-channel MOS transistor PMT11 is turned OFF. When the P-channel MOS transistor PMT11 is turned OFF, the P-channel MOS transistor PMT4 is turned OFF, so that the reference voltage Vsn1 is not outputted.

In FIG. 11, as in the circuit of FIG. 7, a power supply voltage generation circuit 2*b* for BGR circuit is provided with a comparator CMP1, a boosting circuit unit for active state 11, a boosting circuit unit for standby state 12, and a monitor unit 13. Further, the power supply voltage generation circuit 2*b* for BGR circuitb is provided with the P-channel MOS transistor PMT21. As in the circuit of FIG. 7, the reference voltage Vsn1 is inputted into the power supply voltage generation circuit 2*bb*. The power supply voltage generation circuit 2*bb* generates the power supply voltage for BGR circuit Vsn2 and outputs the power supply voltage for BGR circuit Vsn2 to a bandgap reference circuit 3*a*.

The source of a P-channel MOS transistor PMT21 is connected to the external higher voltage supply Vdd. A control signal SBSW is inputted into the gate of the P-channel MOS transistor PMT21. The drain of the P-channel MOS transistor PMT21 is connected on the output side of the comparator CMP1 and on the input sides of a ring oscillator for active state 21 and a ring oscillator for standby state 23.

When the voltage of the higher voltage supply Vdd is equal to the second voltage or more, the control signal SBSW supplied to the gate of the P-channel MOS transistor PMT21 is changed from "High" level to "Low" level. When the control signal SBSW is at "High" level, the P-channel MOS transistor PMT21 is turned OFF. At the time, in response to an output from the comparator CMP1, the ring oscillator for active state 21 and the ring oscillator for standby state 23 output signals at "High" level or at "Low" level. Meanwhile, when the control signal SBSW is at "Low" level, the P-channel MOS transistor PMT21 is turned ON. Accordingly, irrespective of an output from the comparator CMP1, a signal at "High" level is inputted into the ring oscillator for active state 21 and the ring oscillator for standby state 23. As a result, the ring oscillator for active state 21 and the ring oscillator for standby state 23 stop oscillating.

As shown in FIG. 12, a bandgap reference circuit 3*a* is provided with a comparator CMP3, a diode D1, a diode D2, P-channel MOS transistors PMT31 to PMT33, and resistors R31 to R33.

When the voltage of the external higher voltage supply Vdd is equal to or lower than the second voltage higher than the first voltage, the bandgap reference circuit 3*a* uses, as a power supply voltage, the power supply voltage for BGR circuit Vsn2 outputted from the power supply voltage generation circuit 2*b* for BGR circuitb to generate the reference voltage Vbgr. In the case, the control signal SBSW is at "High" level, and a control signal SSW is at "Low" level.

When the voltage of the external higher voltage supply Vdd is equal to or greater than the second voltage, the bandgap reference circuit 3*a* uses the voltage of the external higher voltage supply Vdd as a power supply voltage to generate the reference voltage Vbgr. In the case, the control signal SBSW is at "Low" level, and the control signal SSW is at "High" level.

The reference voltage Vbgr is inputted into one end of the resistor R31. The other end of the resistor R31 is connected to a node N21. One end of the resistor R32 is connected to the node N21. The anode of the diode D1 is connected to the other end of the resistor R32. The cathode of the diode D1 is connected to the lower voltage supply (ground potential) Vss. The reference voltage Vbgr is inputted into one end of the resistor R33. The other end of the resistor R33 is connected to a node N22. The anode of the diode D2 is connected to the node N22. The cathode of the diode D2 is connected to the lower voltage supply (ground potential) Vss.

A signal outputted from the node N21 is inputted into a plus (+) port on the input side of the comparator CMP3. A signal outputted from the node N22 is inputted into a minus (−) port on the input side of the comparator CMP3. The comparator CMP3 compares the signal outputted from the node N21 and the signal outputted from the node N22, and outputs an amplified signal of the difference between these two signals outputted respectively from the nodes N21 and N22.

The source of the P-channel MOS transistor PMT31 is connected to the external higher voltage supply Vdd. The control signal SBSW having a phase opposite to that of the control signal SSW is inputted into the gate of the P-channel MOS transistor PMT31. The drain of the P-channel MOS transistor PMT31 is connected to a node N23. When the control signal SBSW is at "High" level, the P-channel MOS transistor PMT31 is turned OFF. In the case, as to the control signal SBSW, the voltage of the external higher voltage supply Vdd is equal to or less than the second voltage.

When the control signal SBSW is at "Low" level, the P-channel MOS transistor PMT31 is turned ON. In the case, as to the control signal SBSW, the voltage of the external higher voltage supply Vdd is equal to or greater than the second voltage.

The power supply voltage for BGR circuit Vsn2 is inputted into the source of the P-channel MOS transistor PMT33. The control signal SSW is inputted into the gate of the P-channel MOS transistor PMT33. The drain of the P-channel MOS transistor PMT33 is connected to a node N23. When the control signal SSW is at "Low" level and the voltage of the external higher voltage supply Vdd is equal to or less than the predetermined second voltage, the P-channel MOS transistor PMT33 is turned ON. When the control signal SSW is at "High" level and the voltage of the external higher voltage supply Vdd is equal to or greater than the predetermined second voltage, the P-channel MOS transistor PMT33 is turned OFF.

The source of the P-channel MOS transistor PMT32 is connected to the node N23. A signal outputted from the comparator CMP3 is inputted into the gate of the P-channel MOS transistor PMT32. The reference voltage Vbgr is outputted from the drain of the P-channel MOS transistor PMT32.

Figure 13:
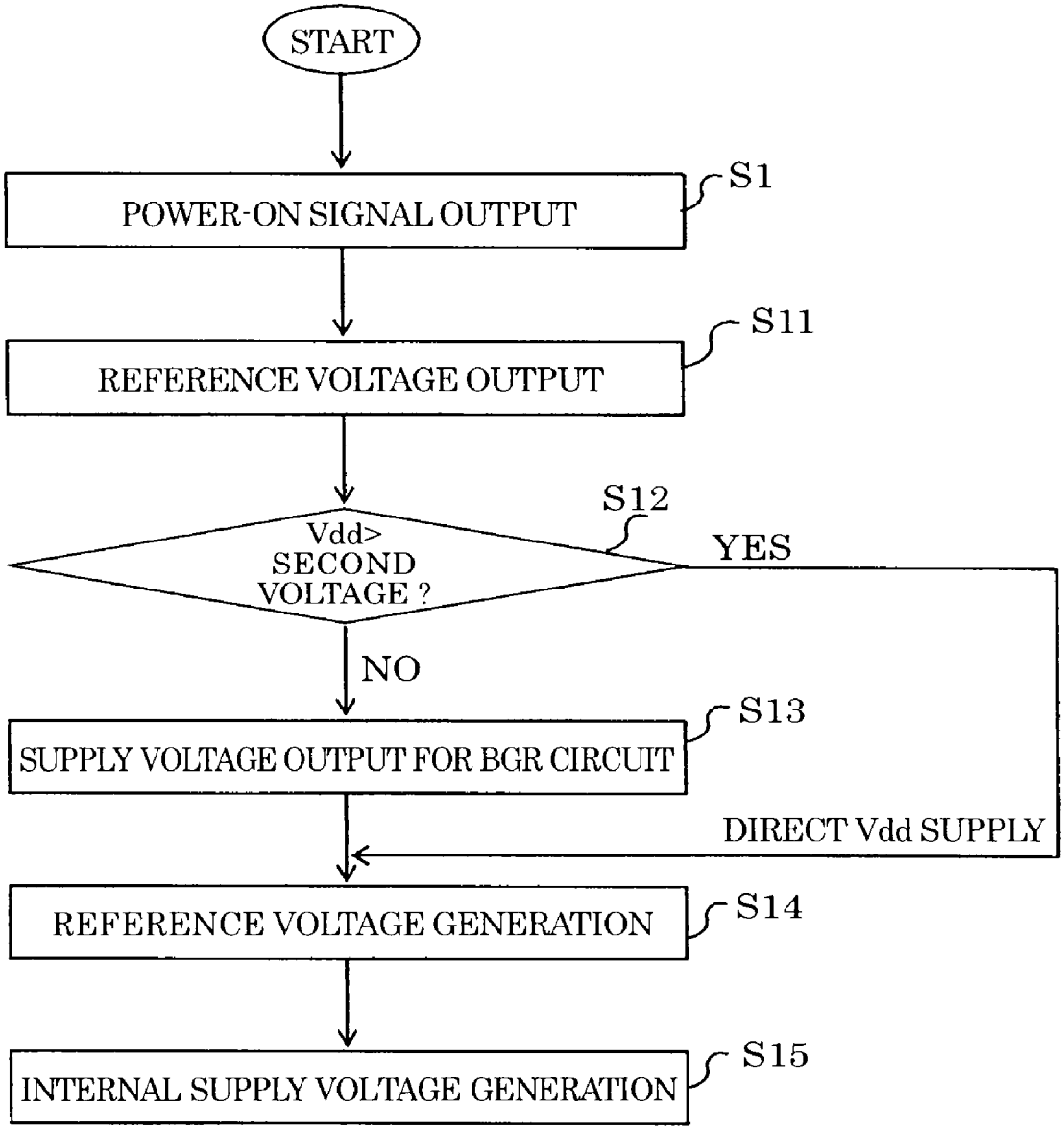
FIG. 13 is a flowchart showing steps of generating an internal power supply voltage of the third embodiment.

Referring to FIG. 13, steps of generating the voltage of the above internal power supply of the third embodiment will be described. FIG. 13 is a flowchart showing steps of generating the internal power supply voltage.

When the external higher voltage supply Vdd is inputted into the power supply circuit 40 (or a power supply circuit 40*a* of FIG. 9) of FIG. 1, the voltage level of the external higher voltage supply Vdd is checked in the power ON/OFF circuit 1.

When the voltage of the external higher voltage supply Vdd rises and reaches a predetermined first voltage or more, the power ON signal Spwon is outputted to the power supply voltage generation unit 2 for BGR circuit from the power ON/OFF circuit 1 (Step S1 of FIG. 13). In the embodiment, the power supply voltage generator 2 is formed of the reference voltage generation circuit 2*aa* and the power supply voltage generation circuit 2*b* for BGR circuitb.

The reference voltage generation circuit 2*aa* of FIG. 10 is started using the power ON signal Spwon, the voltage of the external higher voltage supply Vdd, and the voltage of the higher voltage supply Vdd2 generated by the higher voltage supply 50 shown in FIG. 3. This start-up enables to generate the control voltage Vcmb, and the reference voltage Vsn1 having small temperature and power supply voltage dependencies and having a substantially constant voltage level (Step S11 of FIG. 13).

Subsequently, it is determined whether the voltage of the external higher voltage supply Vdd is equal to or greater than the second voltage (Step S12 of FIG. 10).

When the voltage of the external higher voltage supply Vdd is still equal to or less than the second voltage, the reference voltage Vsn1 and the control voltage Vcmb are inputted into the comparator CMP1 of the power supply voltage generation circuit 2*b* for BGR circuitb of FIG. 11. As a result, with the boosting circuit unit for active state 11 and the boosting circuit unit for standby state 12, the power supply voltage for BGR circuit Vsn2 higher than the reference voltage Vsn1 and the reference voltage Vbgr to be described later is generated (Step S13 of FIG. 13).

In the bandgap reference circuit 3*a* shown in FIG. 12, the power supply voltage for BGR circuit Vsn2 is used as a power supply voltage, and the reference voltage Vbgr having very small temperature and power supply voltage dependencies and having a constant voltage level of 1.21 V, for example, is generated (Step S14 of FIG. 13).

When the voltage of the external higher voltage supply Vdd increases and becomes equal to or greater than the predetermined second voltage, the control signal SSW at "High" level and the control signal SBSW at "Low" level is generated, and the reference voltage Vsn1 is not outputted from the reference voltage generation circuit 2*aa* of FIG. 10. The power supply voltage for BGR circuit Vsn2 is not outputted from the power supply voltage generation circuit 2*b* for BGR circuitb shown in FIG. 11.

In the bandgap reference circuit 3*a* of FIG. 12, on the basis of the external higher voltage supply Vdd, the reference voltage Vbgr having quite small temperature and power supply voltage dependencies and having a constant voltage level is generated. As a result, operations of the reference voltage generation circuit 2*aa* and the power supply voltage generation circuit 2*b* for BGR circuitb is stopped, so that low power consumption can be achieved.

The reference voltage Vbgr outputted from the bandgap reference circuit 3*a* is outputted to the VINT generation circuit of a peripheral voltage supply system of the power supply circuit 40 of FIG. 1 (or the power supply circuit 40*a* of FIG. 9), the VAA generation circuit, and the ½ VAA generation circuit. Furthermore, in the power supply circuit 40*a* of FIG. 9, the reference voltage Vbgr is also outputted to the VPP generation circuit being a core voltage supply system.

In the VINT generation circuit, the VPP generation circuit being a core voltage supply system, the VAA generation circuit, and the ½ VAA generation circuit, on the basis of the reference voltage Vbgr, respective internal power supply voltages are generated (Step S15 of FIG. 13).

The above-described embodiments have been described as power supply circuits for semiconductor memory devices. Alternatively, these power supply circuits may be used for an SoC (System on Chip) and an analog/digital LSI, for example.

Other embodiments or modifications of the present invention will be apparent to those skilled in the art from consideration of the specification and practice of the present invention disclosed herein. It is intended that the specification and example embodiments be considered as exemplary only, with a true scope and spirit of the present invention being indicated by the following.

What is claimed is:

1. A power supply circuit, comprising:

a reference voltage generation circuit;

a power supply voltage generation circuit to receive a first reference voltage from the reference voltage generation circuit, the power supply voltage generation circuit boosting the first reference voltage to generate a boosted power supply voltage; and a bandgap reference circuit to receive the boosted power supply voltage so as to generate a second reference voltage by using the boosted power supply voltage, wherein the reference voltage generation circuit is provided with first and second P-channel transistors, first to fourth N-channel transistors, and first to third resistors, the first P-channel transistor has a source connected to a first higher voltage supply, the second P-channel transistor has a source connected to the first higher voltage supply, a gate of the second P-channel transistor is connected to a drain of the second P-channel transistor and a gate of the first P-channel transistor, a drain of the first N-channel transistor is connected to a drain of the first P-channel transistor, a gate of the first N-channel transistor is connected to the drain of the first N-channel transistor, a gate of the second N-channel transistor is connected to the gate of the first N-channel transistor, a drain of the second N-channel transistor is connected to the drain of the second P-channel transistor, one end of the first resistor is connected to a source of the first N-channel transistor, the first resistor has the other end connected to a lower voltage supply, a drain of the third N-channel transistor is connected to a source of the first N-channel transistor, a gate of the third N-channel transistor is connected to a drain of the third N-channel transistor, the third N-channel transistor has a source to connect to the lower voltage supply, a threshold voltage of the third N-channel transistor is lower than each of the threshold voltages of the first and second N-channel transistors, one end of the second resistor is connected to a source of the second N-channel transistor, the second resistor has the other end to connect to the lower voltage supply, one end of the third resistor is connected to the source of the second N-channel transistor, a drain of the fourth N-channel transistor is connected to the other end of the third resistor, a gate of the fourth N-channel transistor is connected to the drain of the fourth N-channel transistor, the fourth N-channel transistor has a source connected to the lower voltage supply, and a threshold voltage of the fourth N-channel transistor is lower than each of the threshold voltages of the first and second N-channel transistors.

2. The power supply circuit according to claim 1, wherein the power supply voltage generation circuit includes a boosting circuit unit to boost the first reference voltage so as to output the boosted voltage as a power supply voltage.

3. The power supply circuit according to claim 2, wherein the boosting circuit unit includes first and second boosting circuits respectively to operate at the time of standby and active states, the first and second boosting circuits boosting the first reference voltage to output the boosted voltage as the power supply voltage.

4. The power supply circuit according to claim 1, wherein the first and second resistors are set to have the same resistance value, and wherein resistance values R2 and R3 of the second and third resistors, a gate width Wg1 of the third N-channel transistor, a gate length Lg1 of the third N-channel transistor, a gate width Wg2 of the fourth N-channel transistor, and a gate length Lg2 of the fourth N-channel transistor satisfy the following formula:

$$Wg1/Lg1:Wg2/Lg2=1:N$$

$$(R3/R2)\times(k/q)\times\ln(N)=|dVf/dT|$$

where Wg1/Lg1 represents a β ratio of a transistor, k is a Boltzmann constant; q is an electric charge of an electron, |dVf/dT| is temperature dependency of an ON voltage of a pn diode, and N is a mirror ratio of a current flowing through the second P-channel transistor and the second N-channel transistor to a current flowing through the first P-channel transistor and the first N-channel transistor.

5. The power supply circuit according to claim 1, further comprising a power ON/OFF circuit, wherein the first higher voltage supply is an external higher voltage supply, the power ON/OFF circuit has an end connected to the first higher voltage supply, and the power ON/OFF circuit outputs a power ON signal to the reference voltage generation circuit to operate the reference voltage generation circuit when a voltage of the first higher voltage supply is not less than a predetermined voltage.

6. The power supply circuit according to claim 1, wherein the boosted power supply voltage outputted from the power supply voltage generation circuit is used as a voltage for boosting a word line of a semiconductor memory device.

7. The power supply circuit according to claim 2, wherein the power supply voltage generation circuit further includes:

a monitor unit to monitor the power supply voltage so as to output a monitor signal; and a first comparator to receive and to compare the first reference voltage and the monitor signal, so as to output, to the boosting circuit unit, an amplified signal obtained by amplifying a difference between the first reference voltage and the monitor signal, and wherein the reference voltage generation circuit is further provided with a third P-channel transistor and a fourth P-channel transistor and a fifth N-channel transistor, the third P-channel transistor has a source connected to the first higher voltage supply, a gate of the third P-channel transistor is connected to the drain of the second P-channel transistor, the fourth P-channel transistor has a source connected to the first higher voltage supply, a gate of the fourth P-channel transistor is connected to the drain of the second P-channel transistor and the gate of the third P-channel transistor, a drain of the fifth N-channel transistor is connected to a drain of the fourth P-channel transistor, a gate of the fifth N-channel transistor is connected to the drain of the fifth N-channel transistor, a source of the fifth N-channel transistor is connected to the lower voltage supply, the first reference voltage of the reference voltage generation circuit is outputted from the drain of the third P-channel transistor and is inputted into the first comparator, and a control voltage of the first comparator is supplied from a drain of the fourth P-channel transistor and the drain of the fifth N-channel transistor.

8. The power supply circuit according to claim 7, wherein the first higher voltage supply is an internal higher voltage supply unit, the internal higher voltage supply unit generates a voltage on the basis of a voltage of a second higher voltage supply supplied from the outside, and the sources of the first to fourth P-channel transistors are connected to the internal higher voltage supply unit.

9. The power supply circuit according to claim 8, wherein the internal higher voltage supply unit is provided with a resistor and a capacitor, the resistor has one end connected to the second higher voltage supply, the other end of the resistor is connected to one end of the capacitor, the capacitor has the other end connected to the lower voltage supply, and the voltage of the internal higher voltage supply unit is acquired from the one end of the capacitor.

10. The power supply circuit according to claim 8, wherein the reference voltage generation circuit further includes a fifth P-channel transistor, a drain of the fifth P-channel transistor is connected to the source of the third P-channel transistor, a source of the fifth P-channel transistor is connected to the internal higher voltage supply unit, and a first control signal is inputted into a gate of the fifth P-channel transistor.

11. The power supply circuit according to claim 1, wherein the power supply voltage generation circuit further includes:

a monitor unit for monitoring the power supply voltage and outputting a monitor signal;

a comparator to receive and to compare the first reference voltage and the monitor signal so as to output an amplified signal obtained by amplifying a difference between the first reference voltage and the monitor signal;

a boosting circuit unit to output a voltage obtained by boosting the output from the comparator as a power supply voltage; and a sixth P-channel transistor, and wherein the sixth P-channel transistor has a source connected to the first higher voltage supply, a drain of the sixth P-channel transistor is connected to an output end of the comparator, and a second control signal is inputted into a gate of the sixth P-channel transistor.

12. The power supply circuit according to claim 11, wherein the bandgap reference circuit includes seventh to ninth P-channel transistors, the seventh P-channel transistor has a source connected to the first higher voltage supply, the second control signal is inputted into a gate of the seventh P-channel transistor, a drain of the seventh P-channel transistor is connected to a source of the eighth P-channel transistor and a drain of the ninth P-channel transistor, a boosted voltage from the boosting circuit unit is inputted into a source of the ninth P-channel transistor, and an output from the bandgap reference circuit is acquired from a drain of the eighth P-channel transistor.

13. A power supply circuit, comprising:

a reference voltage generation circuit to receive a voltage from a higher voltage supply so as to generate a reference voltage;

a power supply voltage generation circuit to receive the reference voltage from the reference voltage generation circuit, the power supply voltage generation circuit boosting the reference voltage to generate a boosted power supply voltage;

a bandgap reference circuit to receive the boosted power supply voltage so as to generate a reference voltage by using the boosted power supply voltage;

a power ON/OFF circuit to output a power ON signal when a voltage of the higher voltage supply is not less than a first voltage, wherein the reference voltage generation circuit receives the power ON signal from the power ON/OFF circuit to generate the reference voltage; and wherein the bandgap reference circuit outputs the reference voltage based on the voltage of the higher voltage supply when the voltage of the higher voltage supply is higher than a second voltage being higher than the first voltage, and the bandgap reference circuit outputs the reference voltage based on the boosted power supply voltage when the voltage of the higher voltage supply is lower than the second voltage.

* * * * *